US005083109A

United States Patent [19]

McElroy et al.

[11] Patent Number: 5,083,109

[45] Date of Patent: Jan. 21, 1992

[54] ROTATING SOURCE VERIFICATION DEVICE

[76] Inventors: John W. McElroy, 51 Street Rd., Newtown Square, Pa. 19073; P. Leslie Schaumberg, 407 N. Pine St., Langhorne, Pa. 19047

[21] Appl. No.: 547,964

[22] Filed: Jul. 5, 1990

[51] Int. Cl.[5] ..... G08B 19/00; G08B 21/00

[52] U.S. Cl. ..... 340/522; 340/384 R; 340/671; 340/672

[58] Field of Search ..... 340/522, 390, 384 R, 340/384 E, 669-672; 381/58; 367/197-199; 81/19

[56] References Cited

U.S. PATENT DOCUMENTS 3,623,059 11/1971 Rickerd ..... 340/671
3,760,349 9/1973 Keister .
3,792,460 2/1974 Ratz ..... 340/671
3,867,719 2/1975 Perrin .
3,868,684 2/1975 Nunn, Jr. .
3,873,963 3/1975 Neal .
3,949,300 4/1976 Sadler .
4,040,050 8/1977 Nunn, Jr. .
4,195,291 3/1980 Burks, Jr. ..... 340/671
4,212,085 7/1980 Vaillancour .
4,238,778 12/1980 Ohsumi .
4,443,790 4/1984 Bishop .
4,468,664 8/1984 Galvin .
4,489,312 12/1984 Yoshizaki .
4,506,255 3/1985 Sasaki .
4,518,952 5/1985 Tanaka .
4,777,473 10/1988 Weston .

*Primary Examiner*—Donnie L. Crosland
*Attorney, Agent, or Firm*—Paul & Paul

[57] ABSTRACT

A device for monitoring and verifying the operation of a rotating source, such as a rotating civil defense-type siren being tested by sounding the siren for a short period of time, employs a sensor mounted near the siren. The signal from the sensor is amplified, filtered and converted to a sinusoidal signal of the same frequency as the rotation of the siren. The sinusoidal signal is processed to sense siren turn-on, to determine whether the siren rotates more than a predetermined minimum number of times, and to sense siren turn-off. This information is stored and displayed by the device until it can be inspected by an individual, and can be relayed to a remote site.

18 Claims, 4 Drawing Sheets

ROTATING SOURCE VERIFICATION DEVICE

BACKGROUND OF THE INVENTION

1. Field of the Invention

This invention relates to electronic monitoring systems, and more specifically to systems for monitoring an audible signal from a rotating source to verify the operation of the source.

2. Brief Description of the Prior Art

Electronic monitoring systems are known in the art for a variety of purposes, such as, for example, the remote testing of alarm systems, including fire and burglary alarm systems. For example, U.S. Pat. No. 4,777,473 ("Weston") discloses an alarm system incorporating a dynamic range testing feature. In Weston's system an alarm condition is signaled by an open resistive element in an alarm module (e.g. caused by an intruder breaking a window to which the element is adhered or the melting of the resistive element by the heat of a fire). A central alarm system separately measures resistances in each of several modules which it polls. This system incorporates several features intended to minimize false alarm reports For example, when an alarm condition is sensed within the module itself, it is not initially reported, but instead the module must count the presence of an alarm signal in each of three consecutive rolling periods before the alarm condition is reported to the central alarm system.

Additional systems of this type are disclosed in U.S. Pat. No. 4,468,664, 4,489,312 and 4,506,255.

A second type of electronic monitoring system relates to the problem of detecting the presence of the emergency warning signal in a vehicle Emergency vehicles such as ambulances and fire trucks sound their sirens when responding to an emergency. The sirens may not be heard by the drivers of other vehicles until too late to avoid a collision for a number of reasons (e.g. the drivers may have their radios on too loud). In addition, the sound of their own siren makes it difficult to become aware of the presence of a second emergency vehicle responding to the same or a different emergency.

This second type of monitoring system is exemplified by U.S. Pat. No. 4,238,778, which discloses an electronic transmitter-receiver system for warning a motor vehicle driver of the approach of an emergency vehicle. In this system the emergency vehicl· transmits a special radio frequency signal and the target vehicle must be equipped with a special receiver which generates an audible warning signal Additional patents relating to this type of monitoring system include U.S. Pat. Nos. 3,760,349, 3,949,300, and 4,443,790.

Some systems of this type equip the target vehicle with means for signaling the presence of an audible emergency signal such as a siren. For example, U.S. Pat. No. 3,867,719 employs a transducer tuned to approximately 500 hertz and mounted on the outside of the target vehicle. Means are provided to condition the signal generated by the transducer so that an indication of whether the emergency vehicle is moving towards or away from the target vehicle is given. A similar type of device is disclosed in U.S. Pat. No. 4,212,085 which provides the target vehicle driver with a visual indication of the direction of the origin of the siren. U.S. Pat. No. 3,873,963 provides a fairly simple implementation of this type of device.

Another type of audible warning system is the "civil defense" type siren, intended to provide the public at large of an imminent harzard. Although such sirens may be unmistakable to individuals in the locality where they are actually sounded, they may be remotely activated, either automatically, or well out of the hearing of an individual who activates them. To ensure the function and the reliability of these systems they must be periodically tested. There is a need for a monitoring system that which can accurately and reliably monitor when such audible waring systems have been activated, so that fault-free activation of the warning system can be verified. The system should accurately discriminate an audible signal from the warning system from the aural environment to verify the activation of the warning system for test purposes. In addition, the system should be able to operate continuously for long periods of time in the aural environment without erroneously reporting the warning system to have been activated. The monitoring system should provide for verification of correct operation of the warning system at or near the site of the audible siren, and also for verification from remote locations.

SUMMARY OF THE INVENTION

The present invention provides a verification device intended for monitoring the operation of a rotating source which normally is in operation for a predetermined period of time. The rotating source can be an audible warning siren of the "civil defense" type, frequently employed to provide an emergency warning to the public at large. Warning sirens are sometimes installed near facilities such as power plants, dams, and the like, which are potentially hazardous to warn the public at large in the vicinity of those facilities of a hazardous conditions.

Depending on the individual facility and the nature of the geographical extension of the hazard, many sirens may be required to provide an appropriate warning. These sirens are periodically tested to determine that they are operational. Typically, in the past, the proper function of each siren would be verified by an individual observer However, when the number of sirens installed becomes large, directly observing the operation of each becomes impractical for several reasons. One is that it is desirable to monitor the operation of the entire warning system, including each of the individual sirens, at one time, by activating the entire system to test it. Although each individual component of any system may operate perfectly when tested individually, the system itself may not operate as desired, and it may not be possible to determine the source of the problem without testing the system as a whole. In addition, when many sirens are installed, many individual observers are required to monitor the operation of each siren in a test of the system as a whole, and this is impractical. Another reason is that it is very desirable that the system be tested briefly and regularly, so that the public will come to expect the system to be tested at the appointed time. This avoids falsely alarming the public with the test, and contributes to the credibility and efficacy of the warning system if activated in the case of a genuine emergency. If an individual were required to test a number of sirens in a system successively, the test might be spread over many hours or days, and the significant advantages of brief, regular testing of the entire system would be lost.

The present invention provides a means of verifying the correct operation of an individual siren during a system test. At least three aspects of siren operation are tested: First, a means of verifying that the siren has actually been activated is provided. Second, a means of verifying that the siren has rotated through a predetermined number of rotations is provided. Third, a means of verifying that the siren has returned to a quiet state after a predetermined period is provided. Status information relating to each of these three functions is generated by the device. The status information can be stored and displayed at the monitoring site, and relayed to a remote location. For example, the status information from a single siren site can be relayed to a central location and processed along with similar information from other sites to verify correct operation of an entire network of warning sirens associated with a single power plant. The status information can be relayed by a local radio link to provide site-coded information which can be automatically processed by a central computer to provide the warning system operator with an acknowledgment of correct system operation shortly after the sirens have finished sounding.

The device of the present invention does not require an activation signal to begin monitoring the rotating source. Instead, the device is always listening for the rotating source to begin operation. The device preferably includes means for discriminating between the rotating source and environmental noise, such as thunderstorms, the sirens of emergency vehicles, aircraft noises, and the like.

The present invention provides a device for monitoring and verifying the operation of a rotating source preferably comprising a sensor providing a sensor output signal in response to the rotating source. The source normally provides a signal for a fixed period, "normal" operation being operation for purposes of testing the warning system, and operation to actually provide an emergency warning being exceptional. Because the source rotates, the sensor will monitor a source signal that has a time-varying amplitude, and the sensor output signal will have a component with a time-varying amplitude with a time-constant characteristic of the period of the source rotation.

Because the source will typically rotate at a relatively slow rate, on the order of no more than about three or four times per minute, the time-constant for the component of the sensor output signal reflecting source rotation will be on the order of 0.05 hertz, a relatively low frequency signal. On the other hand, the source typically will be sounding with a frequency toward the middle of the audible range, for example, on the order of five to six hundred hertz, and the sensor output signal will also include a component with a time-constant of this magnitude.

The device includes a first signal conditioning means responsive to the sensor output signal and providing a corresponding conditioned signal. The first signal conditioning means preferably includes a bandpass filter for filtering out environmental noise. The bandpass filter is adapted to pass signals with frequencies on the order of the frequency of the source. For example, a bandpass filter passing signals with frequencies on the order of characteristic frequency of the source, such as on the order of five to six hundred hertz can be used, provided the filter "window" is wide enough to permit the sensor output signal component characteristic of source rotation to pass through. The first signal conditioning means also preferably includes a preamplifier for the sensor output signal, such as a gain control amplifier, with the bandpass filter following the preamplifier in the first signal conditioning means.

In addition the first signal conditioning means also preferably includes an RMS converter responsive to the sensor output signal and providing a corresponding RMS converter signal as an output. The RMS converter, preferably follows the bandpass filter in the signal processing chain, functions to convert its input, typically a large amplitude signal having the same frequency as the characteristic frequency of the source, enclosed within a low frequency, sinusoidal "envelope" having the frequency of source rotation, to a large amplitude sinusoidal signal having the frequency of source rotation. This is the "conditioned signal" preferably provided by the first signal conditioning means.

The device also includes a quiet comparator for comparing the amplitude of the conditioned signal to a predetermined quiet threshold level, the quiet comparator output becoming positive when the conditioned signal exceeds the predetermined quiet threshold level. The quiet threshold is preferably set to exceed expected environmental noise. In addition, the device includes a first storage means for storing the instantaneous value of the quiet comparator output when the first storage means is activated. The first storage means can be a latch or flip-flop which stores the value of the quiet comparator after a first predetermined period, this first predetermined period commencing after the device is "turned on" and extending for longer than the test period of the rotating source or siren. The value stored in the latch will then indicate whether the siren has become silent after the end of test or has continued to sound due to some malfunction. This storage means can be preset with a value indicating that the siren is still sounding, so that a quiet siren will be required to subsequently change the value stored in this storage means.

The device further comprises a second signal conditioning means responsive to the conditioned signal, the second signal conditioning means providing a positive output when the amplitude of the conditioned signal varies by at least a predetermined level. Preferably, the second signal conditioning means includes a hysteresis comparator which serves to convert the sinusoidal output of the RMS convertor at its input to a square wave output The device also includes a second storage means for storing a predetermined value, the second storage means being activated by a positive output from the second signal conditioning means. The second storage means can be a latch, such as an edge-triggered D flip-flop, which is activated by applying a square wave from the hysteresis comparator to the latch's clock input, the latch otherwise being set to store the predetermined value in the latch Assuming that the latch would otherwise have been cleared, the presence of the predetermined value in the latch signifies that device has sensed output from the rotating source, that the siren has been sounded since the latch was cleared.

The device also includes rotation counter having a two-state output. The rotation counter is enabled when the quiet comparator output becomes positive. The rotation counter successively counts each positive output from the second signal conditioning means. The rotation counter provides a positive output after a predetermined minimum rotation number has been exceeded, upon receiving an output activation signal. The positive output signifies that rotating source has in fact rotated at least the minimum number of times anticipated A negative output can indicate a mechanical problem with rotation of the source.

In addition, the device comprises a first sequencer, or timing and control circuit, as well as a second sequencer. The first sequencer is triggered when the quiet comparator output becomes positive. The first sequencer measures or times the first predetermined period, the first predetermined period being longer than the normal fixed period of operation of the source. For example, the first predetermined period can be about four minutes, when the normal fixed period of operation of the source is on the order of a minute or so. Subsequently, at the end of the first predetermined period, when the first sequencer "times out" the first predetermined period, the first sequencer activates the first storage means and the rotation counter output, and also then triggers the second sequencer.

The second sequencer performs a number of housekeeping functions in the device. The second sequencer measures a second predetermined period after being triggered The second predetermined period can be much shorter than the first, such as on the order of a second or so. The second predetermined period provides a "window of opportunity" for the results of monitoring the rotating source with the device during the first predetermined period to be displayed, such as with indicator lights, to be transferred into an associated long term memory, and or to be dispatched to a remote location, such as for processing by a central computer located in the control room of a power plant. At the end of the second predetermined period the second sequencer resets the rotation counter, and clears the second storage means, and "clears" the first storage means, as by presetting it with a value indicating that the siren is sounding, thereby readying the device to monitor and verify subsequent activation, rotation, and deactivation of the source.

The device can thus accurately and reliably monitor when an audible warning system containing a rotating audible source has been activated, and fault-free activation of the warning system can be verified by the device. The device can accurately discriminate an audible signal from the warning system from the aural environment to verify activation of the warning system for test purposes. In addition, the device can operate continuously for long periods of time in the aural environment without erroneously reporting the ·arning system to have been activated. The device can verify correct operation of the warning system at or near the site of the audible siren, by use of a perceptible indication of the contents of the first and second storage means and the output of the rotation counter at end of the first predetermined period, such as by displaying this information with indicator lights. This information can be transmitted to a remote location to verify correct operation of the system.

DETAILED DESCRIPTION OF THE PREFERRED EMBODIMENTS

Figure 1:
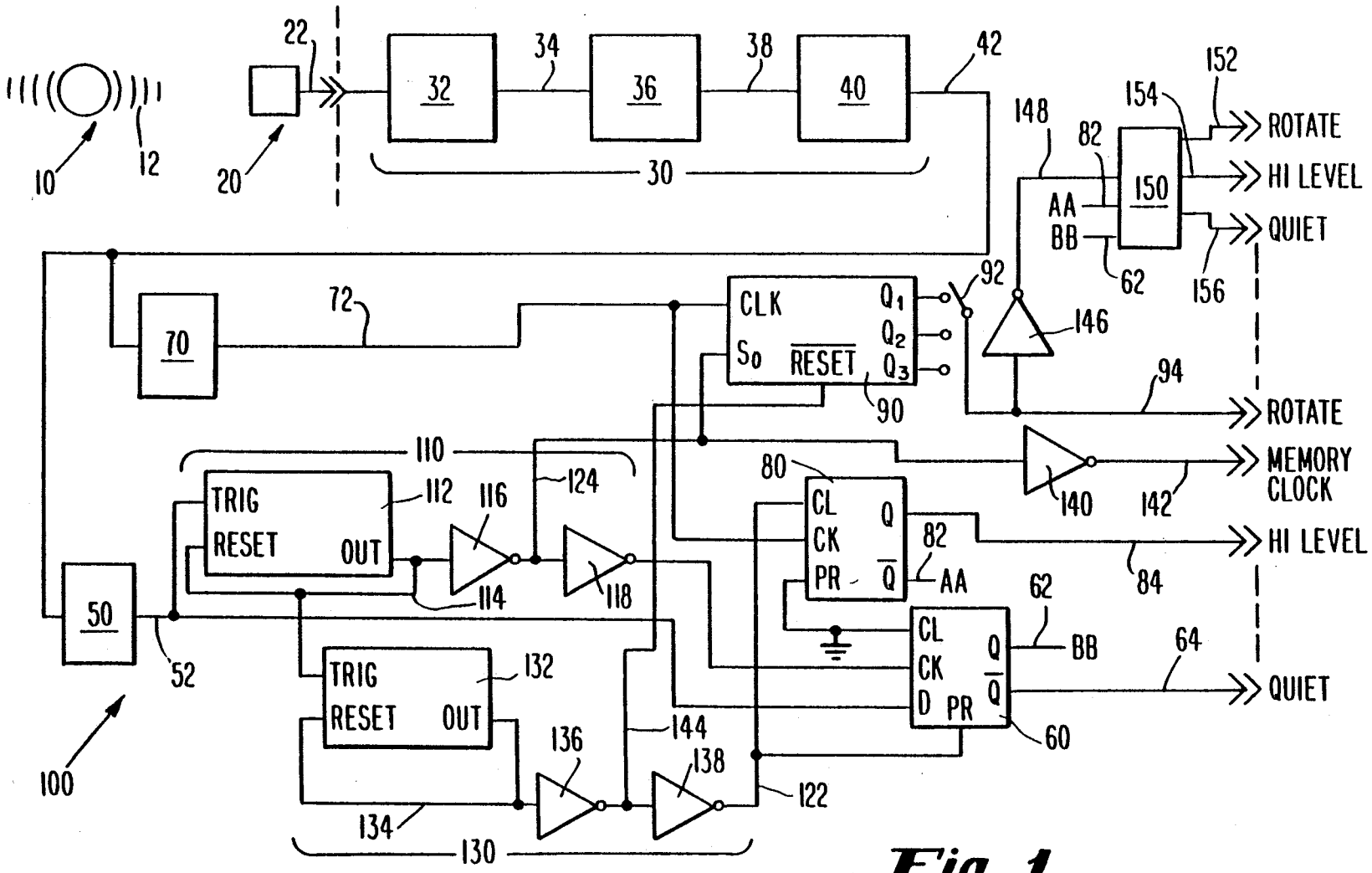
FIG. 1 is a schematic illustration of a presently preferred embodiment of a device for monitoring and verifying the operation of a rotating source according to the present invention.
Figure 3:
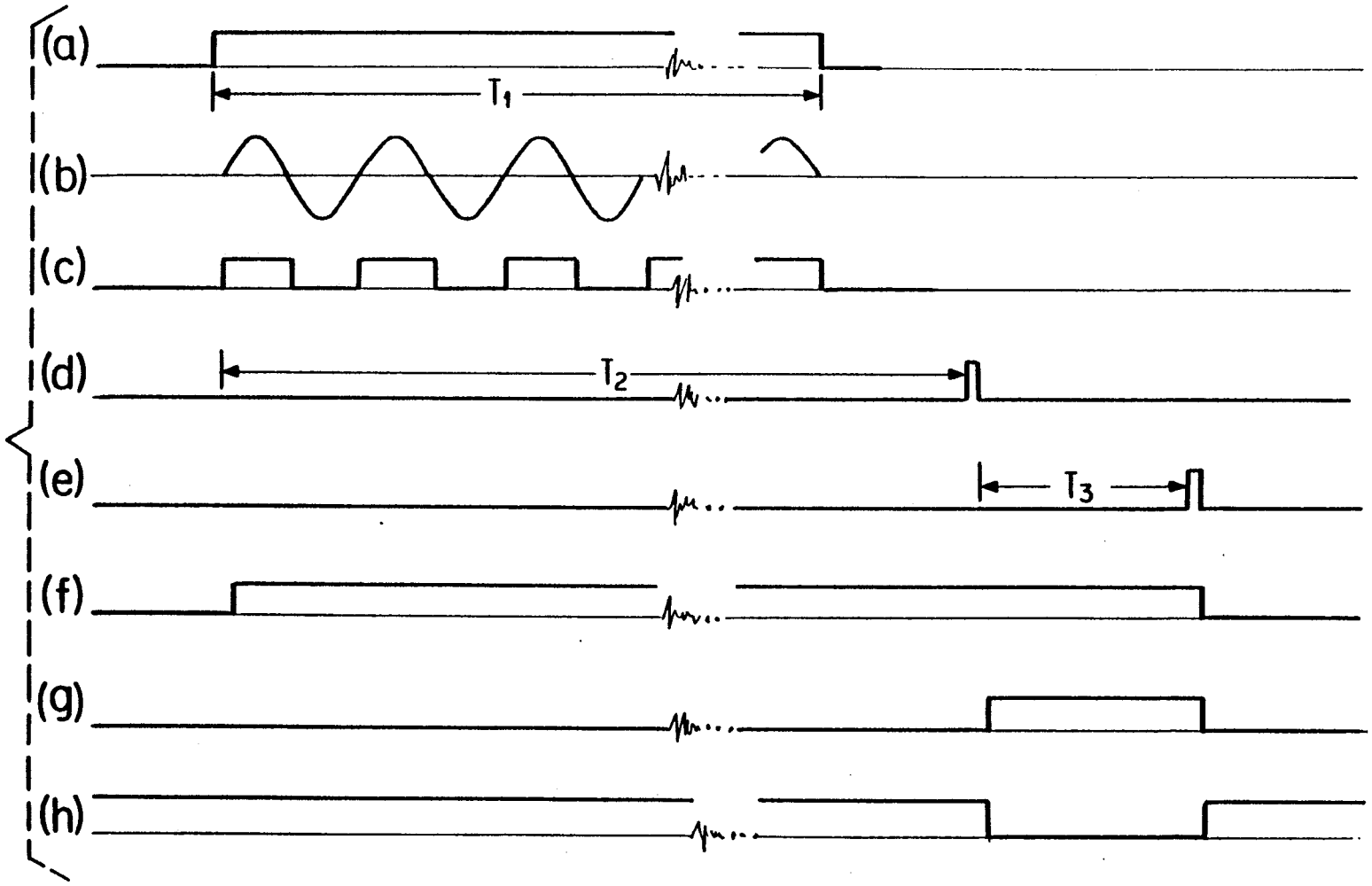
FIG. 3 is a timing diagram illustrating operation of the device of FIG. 1.

Referring now to the drawings in detail, wherein like reference numerals indicate like elements in each of the several figures, reference is first made to FIG. 1, in which a presently preferred embodiment of a device 100 according to the present invention for monitoring and verifying the operation of a rotating source 10 is shown schematically. The rotating source or siren 10 produces an audible signal 12, such as to warn the public at large of an imminent hazard The siren 10 is periodically tested briefly to determine whether it is operating properly, by sounding the siren 10 for a brief predetermined period $T_1$, such as shown in the timing diagram of FIG. 3 long enough to permit proper operation of the source 10. For example, the siren 10 may be activated to produce the audible signal 12 for a minute or more.

Figure 2:
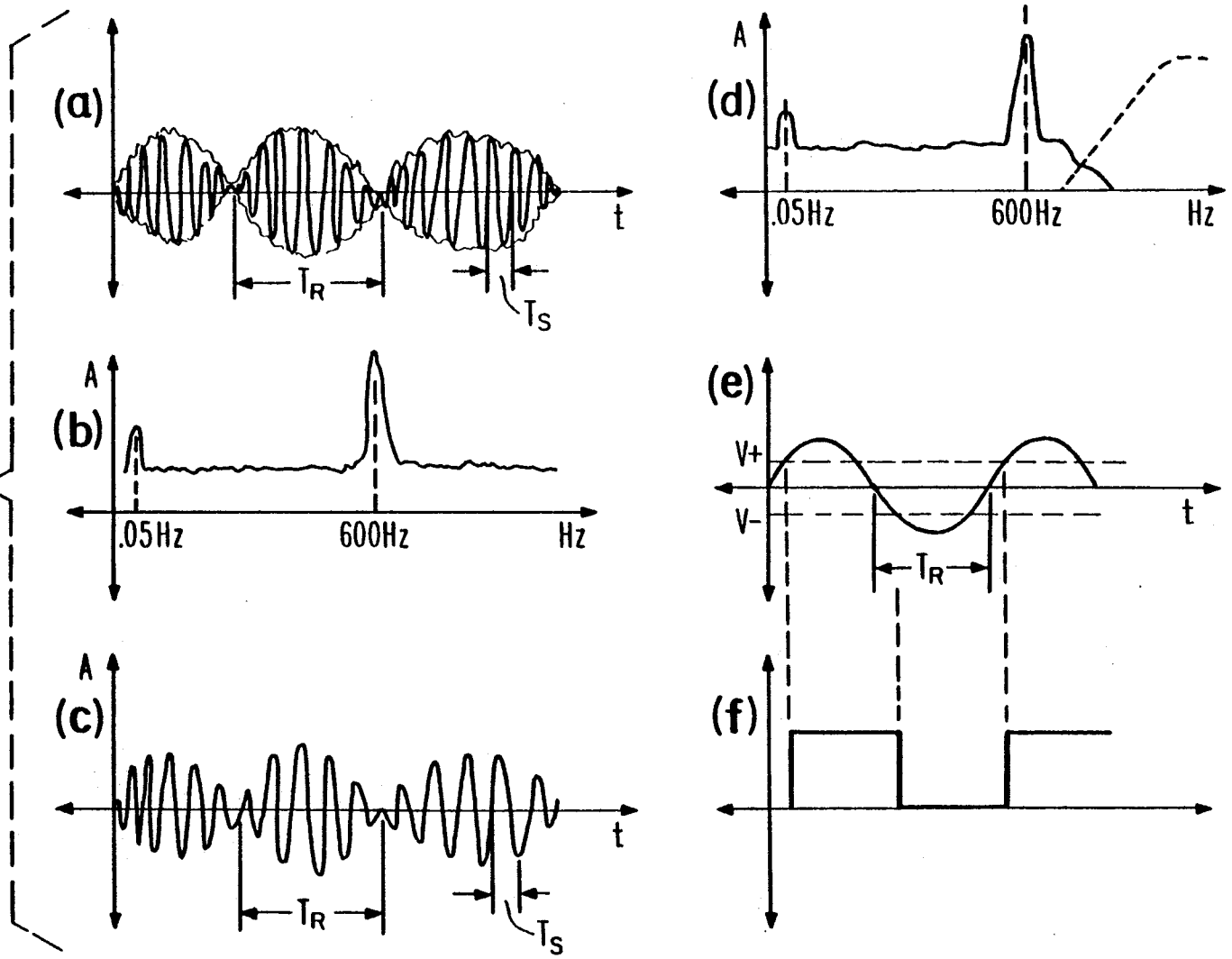
FIG. 2 includes illustrations of waveforms generated in the device of FIG. 1.

The audible signal 12 is sensed by a sensor 20, such as a piezoelectric air pressure transducer, or microphone, capable of sensing audible sounds The sensor 20 is preferably mounted near the siren 10, which itself is typically positioned in an elevated position to maximize its efficacy as a warning device, such as at the top of a long pole or tower (not shown). In this case, the sensor 20 can be mounted near the siren 10. For example, the sensor 20 can be mounted about four feet below the siren 10 on the pole or tower. The sensor 20 generates an output signal having a time-varying amplitude in response to the rotating source 10, the output signal being conveyed on a line or cable 22, preferable a shielded coaxial cable of the type employed to transmit low voltage signals, to the device 100 mounted at or near the base of the pole or tower in a suitable cabinet (not shown) for facile access. The sensor output is represented in the time domain in FIG. 2(*a*), and in the frequency domain in FIG. 2(*b*), showing most of signal amplitude in a band around 550 Hz, with a small amplitude signal band at about 0.05 Hz, characteristic of the rotation of the source 10. There is also shown schematically an environmental "white" noise background at low level, although the actual environmental noise may have significantly more structure.

Depending on the characteristics of the specific sensor 20 used, the characteristics of the cable 22, and the length of cable 22 extending between the sensor 20 and the input to the device 100, the sensor signal may be preamplified (not shown) by suitable amplification means to ensure that a signal with a high signal-to-noise radio is provided to the device 100.

As shown in FIG. 1, the sensor output signal on the cable 22 is input to a first signal conditioning means 30 which includes a gain control amplifier 32, a bandpass filter 36, and an RMS convertor or peak-to-peak detector 40. The gain control amplifier 32 amplifies the sensor signal on the cable 22 to provide a time-varying signal with a fixed maximum amplitude at its output to a line 34 linking the output of the gain control amplifier 32 with the input of the bandpass filter 36. The waveform of the output of the gain control amplifier 32 is similar to that represented in FIG. 2*a*, but the amplitude maxima are fixed by the amplifier set point. The bandpass filter 36 is selected to pass a band of frequencies including those produced by sounding the siren, typically on the order of five to six hundred Hertz, while excluding high frequency and very low frequency noise. The output of the bandpass filter 36 is shown in the time domain in FIG. 2*c*, and in the frequency domain in FIG. 2*d*. The band passed is broad enough so that the filter 36 is transparent to the low frequencies associated with modulation of the siren's 10 characteristic frequencies by rotation (rotation period $T_r$).

The resulting signal from the bandpass filter 36 is applied to a line 38 connecting the output of the bandpass filter 36 with the input of the RMS converter 40. The RMS converter 40 functions to convert its input, a large amplitude signal having the same frequency as the characteristic frequency of the source 10 (FIG. 2*c*, period $T_s$), enclosed within a low frequency, sinusoidal "envelope" having the frequency of source rotation, to a large amplitude sinusoidal signal having the frequency of source rotation (FIG. 2*e*). This conditioned signal is provided by the first signal conditioning means 30 at the output of the RMS converter to a line 42, extending to the input of a quiet comparator 50 and a second signal conditioning means 70, as shown in FIG. 1.

The quiet comparator 50 compares the amplitude of the conditioned signal to a predetermined quiet threshold level or voltage. The quiet threshold voltage is set high enough so that random audible environmental noise, such as thunderclaps, noises generated by passing vehicles, and the like are unlikely to produce a sufficiently high conditioned signal to exceed the threshold. When the conditioned signal exceeds the predetermined quiet threshold level, a positive voltage is produced at the output of the quiet comparator 50 and applied to its output line 52. The positive voltage on the quiet comparator output line 52 is applied to the trigger input TRIG of a first sequencer or timing and control circuit 110, and to the input D of a first storage means or "quiet" flip-flop 60. The quiet flip-flop 60 is an edge-triggered D or T-delay type latch, which stores the instantaneous value of the quiet comparator output on the output line 52 when the first synchronous latch 60 is subsequently activated by applying a HIGH signal to its clock input CK.

The second signal conditioning means or hysteresis comparator 70, provides a positive output on its output line 72 when the amplitude of the voltage of the conditioned signal on the line 42 from the RMS converter 40 varies by at least a predetermined level. The sinusoidal signal from RMS converter 40 is converted by the hysteresis comparator 70 to a square wave (FIG. 2*f*), with each positive half cycle of the sinusoidal input providing a corresponding positive output on the output line 72, a positive half cycle of the square wave. The output of the hysteresis comparator 70 is applied through the output line 72 to the clock inputs of a second storage means 80 and a rotation counter 90.

The second storage means or "high level" flip-flop 80 is also an edge-triggered D-type latch Initially, the Q output of the high level flip-flop 80 is set LOW and the $\overline{Q}$ output is set HIGH. Its PR or PRESET input is grounded, and its D input is set HIGH so that when a positive output, or clock pulse, from the hysteresis comparator 70 is applied to its CK or clock input, its Q output is set HIGH and its $\overline{Q}$ output is set LOW. This will occur when the source or siren 10 is first activated, whether or not it rotates, so that the positive value or HIGH at the Q output of the high flip-flop 80 indicates that the siren 10 has sounded. This is shown schematically in FIG. 3, a timing diagram for operation of the device 100, at FIG. 3*f*.

In the timing diagram, the source 10 is shown to be active for a period $T_1$ beginning at time 0 (FIG. 3*a*), the period $T_1$ is on the order of a minute or more. The output of the RMS converter is shown at FIG. 3*b*, and that of the hysteresis converter at 3*c*. Each of these signals terminate at the end of the $T_1$ period.

As shown in FIG. 1, the rotation counter 90 is a four-bit shift register which increments each time a positive output, the leading edge of a positive square wave half-cycle, is applied to its CLK or clock input. When the SO input to the rotation counter goes LOW, signals are applied to each of outputs $Q_1$, $Q_2$, and $Q_3$ as follows: When more that a single rotation has been counted, $Q_1$ is set HIGH. Similarly, when more than three rotations have been counted, $Q_2$ is set HIGH; and when more than seven rotations have been counted, $Q_3$ is set HIGH. A switch 92 can be manually set to connect a rotation counter output line 94 with any one of rotation counter outputs $Q_1$, $Q_2$, or $Q_3$, so that the rotation counter output line 94 will be HIGH if more than a single rotation has occurred, the HIGH on line 94 indicating that more than one, three, or seven rotations have occurred, depending on the setting of the switch 92 (FIG. 3*g*).

The device 100 also includes a first sequencer 110 comprising a first timer 112 and a pair of inverters 116, 118. The first timer 112 is triggered when the output of quiet comparator 50 first becomes positive, just when turn-on of the source 10 is sensed by the device 100. The first timer is set to run for a first predetermined period, $T_2$ (FIG. 3*d*) of about four minutes, long enough to permit the source to return to a quiet state after a typical test. When the first timer times out, a positive output appears at its OUT terminal and is applied through a line 114 to the input of a first inverter 116, to the TRIGGER input of a second timer 132, and to the RESET input of the first timer 112, readying the first timer 112 for another cycle. The output of the first inverter 116 is applied through a line 124 to the $S_0$ input of the rotation counter 90, and to the input of the second inverter 118. The output of the second inverter is applied to the CK or clock input of the quiet flip-flop 60. If the output of the quiet comparator 50 is still positive, indicating that source 10 is still sounding, a positive signal is being applied through the quiet comparator output line 52 to the D input of the quiet flip-flop 60, and the Q output of the quiet flip-flop 60 goes HIGH and the $\overline{Q}$ output of the quiet flip-flop 60 goes LOW, when this flip-flop 60 is clocked. Conversely, if the output of the quiet comparator 50 is no longer positive, indicating that the source 10 is no longer sounding, the Q output of the quiet flip-flop 60 will be set LOW and the $\overline{Q}$ output will be set HIGH, when the quiet flip-flop 60 is clocked at the end of the four minute period measured by the first timer 112 (FIG. 3*h*).

Figure 4:
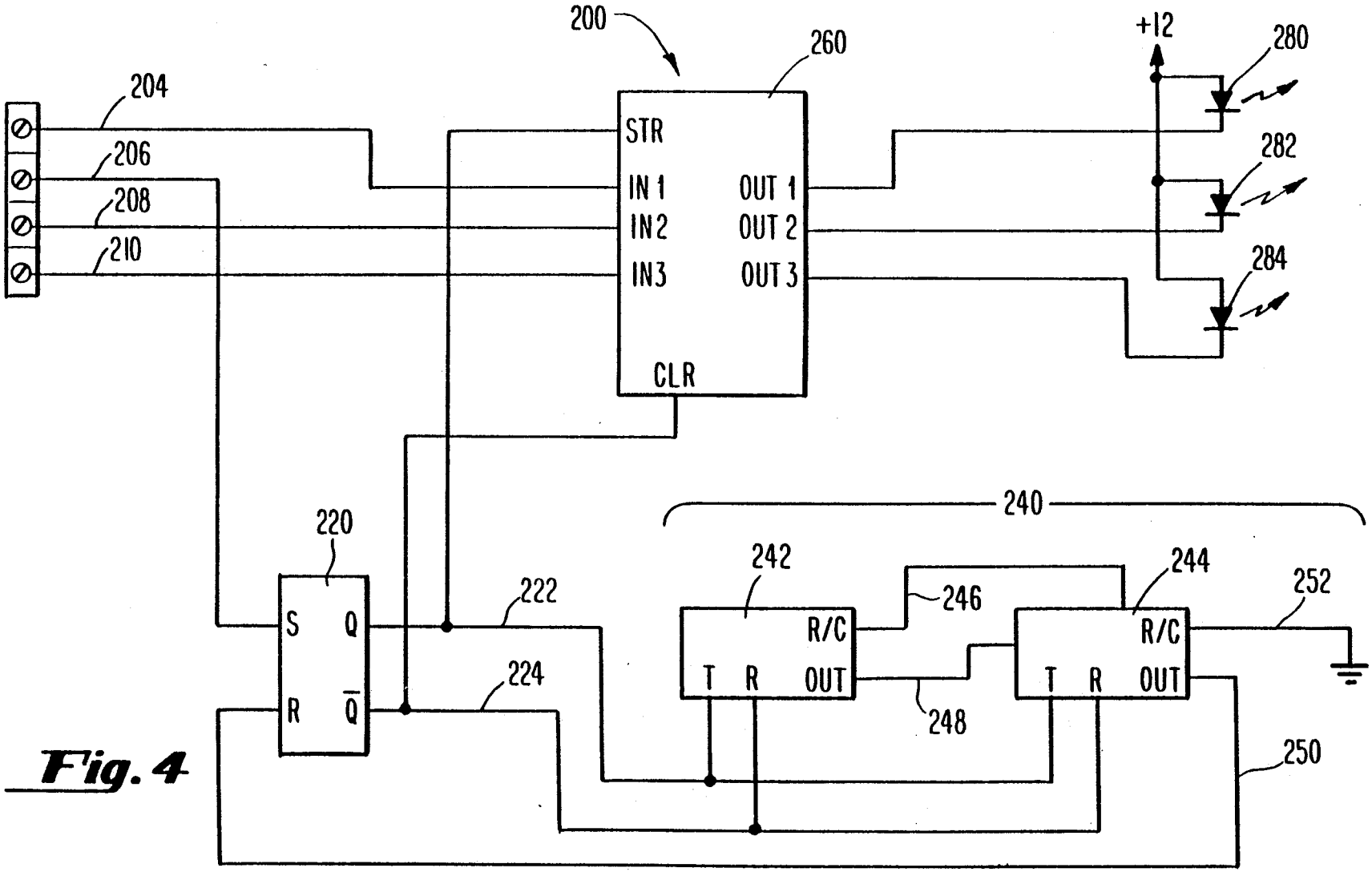
FIG. 4 is a schematic illustration of memory and display unit according to the present invention for use with the device of FIG. 1.

At the end of the four minute period, each of the three outputs of the device 100 are available on the device output lines 64, 84 and 94, which are terminated by a cable socket for connection with a memory and display unit 200 (FIG. 4). A HIGH on the first device output line 94 indicates that a predetermined number of rotations has been exceeded. A HIGH on the second device output line 84 indicates that the source 10 has sounded; and a HIGH on the third device output line 64 indicates that the source has returned to its quiet state.

The device 100 further includes a second sequencer 130 comprising a second timer 132 and another pair of inverters 136, 138. The second timer 132 is triggered when the first timer 112 times out at the end of the first, four minute-long, predetermined period. The second timer is set to run for a second predetermined period, $T_3$ (FIG. 3*e*), of about one second, long enough to permit the data on the device output lines 64, 84, 94 to be sampled, stored and displayed by the memory and display unit 200. When the second timer times out, a positive output appears at its OUT terminal and is applied through a line 134 to the input of a first inverter 136, and to the RESET input of the second timer 132, readying the second tiger 132 for another cycle. The output of the first inverter 136 is applied through a line 144 to the RESET input of the rotation counter 90 to reset the rotation counter, readying it for another cycle, and to the input of the second inverter 138. When the rotation counter 90 is reset, each of its outputs $Q_1$, $Q_2$ and $Q_3$ is set LOW, as is the first device output line 94 (FIG. 3*g*). The output of the second inverter 138 is applied through a line 122 to the PR or preset input of the quiet flip-flop 60 and to the CL or clear input of the high level flip-flop 80. The positive signal applied to the preset input of the quiet flip-flop latch 60 sets the Q output of the flip-flop HIGH and the $\overline{Q}$ output, and the third device output line 64 LOW, readying the quiet flip-flop 60 for another cycle (FIG. 3*h*). The positive signal applied to the clear input of the high level flip-flop 80 set the Q output and second device output line 84 LOW, and the $\overline{Q}$ output HIGH (FIG. 3*f*). Thus, at the end of the one second-long second predetermined period, each of the device output lines 64, 84, and 94 has been set LOW.

In order to supply the memory and display unit 200 with a clock pulse, the line 124 from the output of the first inverter 116 of the first sequencer 110 is also connected to the input of another inverter 140, the output of which is applied to a fourth device output line 142. Thus, a positive pulse appears on the fourth device output line 142 at the end of the first, four minute-long, predetermined period.

In order to supply the information regarding the test of the source 10 determined by device 100 to a remote location, such as the central control room of a power plant, or the like, the device is provided with a second set of device output lines 152, 154, 156 which terminate in a socket for connection with a transmission device, such a radio transmitter, or a driver for transmitting the information over a cable, an encoder for transmitting the information over telephone lines, or a like device (not shown). To electrically insulate the transmission device from the device 100, a three-channel optoisolator 150 is provided. The inputs to the optoisolator 150 are fed from the Q output of the quiet flip-flop 60 on one line 62 and from the $\overline{Q}$ output of the high level flip-flop 80 on another line 82 (through BB and AA, FIG. 1), as well as from the output $Q_1$, $Q_2$, or $Q_3$ of the rotation counter 90 selected by the switch 92 through another inverter 146 and line 148.

The memory and display unit 200 is connected to the device 100 by a shielded cable (not shown) which, in addition, to supplying the four device output signals on the device output lines 64, 84, 94 and 142 also provides the unit 200 with power (not shown).

As shown schematically in FIG. 4, the memory and display unit 200 includes a asynchronous RS flip-flop 220, a third sequencer 240, a memory/lamp driver 260, and three status-indicating lamps 280, 282, and 284.

Input lines 204, 206, 208 and 210 extend from a socket for receiving the shielded cable connecting the device 100. The memory clock pulse applied to the fourth device output line 142 (FIG. 1) at the end of the first predetermined period is transmitted through the shielded cable to an input line 206 in the unit 200 and applied to the S or set input of the SR flip-flop 220, setting the Q output HIGH and the $\overline{Q}$ output LOW. The signals on the other three device output lines 64, 84, 94 are transmitted over the shielded cable to three corresponding unit input lines 204, 208, 210 and applied to three corresponding inputs IN1, IN2 and IN3 of the memory/lamp driver 260. The Q output of the RS flip-flop 220 is applied to a line 222 and thence to the STR or strobe input of the memory/lamp driver, and the signals applied at the inputs IN1, IN2 and IN3 are strobed into corresponding internal latches in the memory/lamp driver. The contents of the three internal latches are fed to three corresponding internal lamp drivers the outputs of which appear at the OUT1, OUT2 and OUT3 outputs of the memory/lamp driver 260. Each of these outputs is connected to a corresponding superbright LED 280, 282, 284 which thus give a perceptible, visual indication of status of each of the three source test characteristics monitored by the device 100. Each of the three LED lamps 280, 282, 284 can provide a different color, such as red, yellow and green, so that an observer can tell at a glance whether the source 10 tested successfully. For example, a flowing green LED 284 would indicate that the source 10 was now quiet; a glowing yellow LED 282 would indicate that the source 10 had actually sounded; and a glowing red LED 280 would indicate that the source 10 had rotated for at least the predetermined number of rotations during the test.

The positive output at the Q terminal of the RS flip-flop 220 is also applied through a line 222 to the T or trigger inputs of a pair of timers 242, 244 of the third sequencer 240. The timers 242, 244 are configured through connecting lines 246, 248, 252 and additional components (not shown) so that the second timer 244 times out after a predetermined period (for example, forty-eight hours), at which time the OUT terminal of the second timer 244 goes HIGH. This signal is applied via a line 250 to the R or reset input of the SR flip-flop 220, thereby setting the Q output LOW and the $\overline{Q}$ output HIGH. The positive signal at the $\overline{Q}$ output of the RS flip-flop 220 is applied over a line 224 to the CLR or clear input of the memory/lamp driver 260 clearing the internal flip-flops and extinguishing the lamps 280, 282, 284, as well as to the R or reset inputs of the two timers 242, 244. Thus, after a test, the lamps 280, 282, and 284 will remain illuminated for a predetermined period (for example, forty-eight hours). The unit 200 can also be cleared by disconnecting the power fed to the unit through the shielded cable (not shown).

Various modifications can be made in the details of the construction, the use and the operation of the embodiments of the present invention, all within the spirit and scope of the present invention as defined by the appended claims.

We claim:

1. A device for monitoring and verifying the operation of a rotating source, the source normally providing a signal for a fixed period, the device being adapted to respond to a sensor providing a sensor output signal in response to the rotating source, the device comprising:

a first signal conditioning means responsive to the sensor output signal and providing a corresponding conditioned signal, the conditioned signal having a time varying amplitude;

a quiet comparator for comparing the amplitude of the conditioned signal to a predetermined quiet threshold level, the quiet comparator output becoming positive when the conditioned signal exceeds the predetermined quiet threshold level;

a first storage means for storing the instantaneous value of the quiet comparator output when the first storage means is activated;

a second signal conditioning means responsive to the conditioned signal, the second signal conditioning means providing a positive output when the amplitude of the conditioned signal varies by at least a predetermined level, a second storage means for storing a predetermined value, the second storage means being activated by a positive output from the second signal conditioning means;

a rotation counter having a two-state output, the rotation counter successively counting each positive output from the second signal conditioning means, the rotation counter providing a positive output after a predetermined minimum rotation number has been exceeded upon receiving an output activation signal; and a first sequencer and a second sequencer, the first sequencer being triggered when the quiet comparator output becomes positive, the first sequencer measuring a first predetermined period, the first predetermined period being longer than the normal fixed period of operation of the source, and subsequently, at the end of the first predetermined period, activating the first storage means and the rotation counter output, and triggering the second sequencer;

the second sequencer measuring a second predetermined period after being triggered, and resetting the rotation counter, and clearing the second storage means and the first storage means, at the end of the second period.

2. A device according to claim 1 further comprising a sensor providing the sensor output signal in response to the rotating source, the sensor output signal having a time varying amplitude.

3. A device according to claim 2 wherein the first signal conditioning means comprises an RMS converter responsive to the sensor output sigr. ¹, the conditioned signal being the RMS converter output.

4. A device according to claim 3 wherein second signal conditioning means comprises a hysteresis comparator having a square wave output, a positive output of the second signal conditioning means being the increased amplitude at the onset of a single, full square wave cycle.

5. A device according to claim 4 wherein the first storage means comprises a first latch, the first latch storing the instantaneous value of the quiet comparator output when activated at the end of the first predetermined period, the first latch being cleared at the end of the second predetermined period.

6. A device according to claim 5 wherein the second storage means comprises a second latch, the second latch storing a positive value when initially activated by the increase in amplitude at the beginning of a square wave from the hysteresis comparator, the second latch being cleared at the end of the second preset period.

7. A device according to claim 6, further comprising a first driver for providing a perceptible indication of the state of the rotation counter output, a second driver for providing a perceptible indication of the state of the first latch, and a third driver for providing a perceptible indication of the state of the second latch.

8. A device according to claim 7, further comprising memory means for storing the state of the rotation counter output, the state of the first latch, and the state of the second latch.

9. A device according to claim 8 wherein the first sequencer provides a memory activation signal to the memory means at the end of the first period, the state of the rotation counter output, the state of the first latch, and the state of the second latch being stored in the memory means when the memory activation signal is provided.

10. A device according to claim 9 further comprising a third sequencer, the third sequencer being triggered when the state of the rotation counter output, the state of the first latch, and the state of the second latch are stored in the memory means, the third sequencer measuring a third predetermined period, and subsequently, at the end of the third predetermined period, clearing the memory means and resetting itself.

11. A device according to claim 10, further comprising a first driver for providing a perceptible indication of the memory-stored state of the rotation counter output, a second driver for providing a perceptible indication of the memory-stored state of the first latch, and a third driver for providing a perceptible indication of the memory-stored state of the second latch.

12. A device according to claim 1 further comprising means for transmitting the state of the rotation counter output, the state of the first storage means, and the state of the second storage means to a location remote from the sensor location.

13. A device according to claim 12 further comprising optical isolation means for electronically insulating the transmitting means from the rotation counter and the first and second storage means.

14. A device according to claim 1 wherein the first signal conditioning means further comprises an automatic gain control amplifier amplifying the output of the sensor.

15. A device according to claim 14 wherein the first signal conditioning means further comprises a bandpass filter conditioning the output of the automatic gain control amplifier, the bandpass filter being adapted to pass signals with frequencies on the order of the frequency of rotation of the source.

16. A device according to claim 2 wherein the sensor comprises an air pressure transducer capable of sensing audible sounds.

17. A device according to claim 16 wherein the sensor comprises a piezoelectric air pressure transducer.

18. A device for monitoring and verifying the operation of a rotating source, the source normally providing a signal for a fixed period, the device comprising:

a sensor providing a sensor output signal in response to the rotating source;

an RMS converter responsive to the sensor output signal and providing a corresponding RMS convertor signal;

a quiet comparator for comparing the amplitude of the RMS converter signal to a predetermined quiet threshold level, the quiet comparator output becoming positive when the RMS converter signal exceeds the predetermined quiet threshold level;

a first latch for storing the instantaneous value of the quiet comparator output when the first latch is activated;

a hysteresis comparator responsive to the RMS converter signal, the hysteresis comparator providing a square wave output:

a second latch activated by a square wave from the hysteresis comparator;

a rotation counter having a two-state output, the rotation counter being enabled when the quiet comparator becomes positive; the rotation counter successively counting the square waves at the output of the hysteresis comparator, the rotation counter providing a positive output after a predetermined minimum rotation number has been exceeded upon receiving an output activation signal; and a first sequencer and a second sequencer, the first sequencer being triggered when the quiet comparator output becomes positive, the first sequencer measuring a first predetermined period, and subsequently, at the end of the first predetermined period, activating the first latch and the rotation counter output, and triggering the second sequencer;

the second sequencer measuring a second predetermined period after being triggered, and resetting the rotation counter, the first latch, and the second latch, at the end of the second period.

* * * * *

UNITED STATES PATENT OFFICE

CERTIFICATE OF CORRECTION

Patent No. 5,083,109 Dated January 21, 1992

Inventor(s) McElroy et al.

It is certified that error appears in the above-identified patent and that said Letters Patent is hereby corrected as shown below:

Column 1, Line 34, after the word "vehicle", insert a -- . --.

Column 1, Line 52, after the word "signal", insert a -- . --.

Column 2 Line 11, delete the word "waring" and insert therefor -- warning --.

Column 5, line 49, delete the word "arning" and insert therefor -- warning --.

Column 6, line 19, after the number 3, insert a -- , --. and 29.

Colums 10, line 28, delete the word "flowing" and insert therefor -- glowing --.

Signed and Sealed this

Twenty-seventh Day of April, 1993

*Attest:*

MICHAEL K. KIRK

*Attesting Officer*

*Acting Commissioner of Patents and Trademarks*